US006286398B1

(12) United States Patent
Huang

(10) Patent No.: US 6,286,398 B1
(45) Date of Patent: Sep. 11, 2001

(54) COMBINATION WRENCH WITH ADJUSTABLE HEADS

(76) Inventor: Yueh-Nu Huang, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/478,937

(22) Filed: Jan. 6, 2000

(51) Int. Cl.[7] ..... B25B 13/28
(52) U.S. Cl. ..... 81/90.1; 81/90.3; 81/91.2
(58) Field of Search ..... 81/90.1, 90.3, 81/91.2, 91.3, 126

(56) References Cited

U.S. PATENT DOCUMENTS 4,913,011 * 4/1990 Ma ..... 81/90.1
5,050,464 * 9/1991 Hurtig ..... 81/90.3 X

* cited by examiner

*Primary Examiner*—James G. Smith

(57) ABSTRACT

A combination wrench with adjustable heads is provided. The wrench includes a handle and a open head and box head respectively pivoted to two ends of the handle. The open head is combined with a first and a second clamping jaws in shear arrangement. The box head is combined with a first and a second web pivoted together at their distal portions. When rotate the handle counterclockwise, both the open head and the box head can be able to firmly comp a wording object and then to fasten or unfasten the object. The handle can make back runs when it rotates clockwise.

5 Claims, 5 Drawing Sheets

COMBINATION WRENCH WITH ADJUSTABLE HEADS

BACKGROUND OF THE INVENTION

The present invention relates to carpentry tools and more particularly to a combination wrench with adjustable heads which can be automatically adjusted to consist with the size of an object such as a nut to which it rotates.

People usually use different sizes of combination wrenches to work at different sized nut which is uneconomical. A typical adjustable combination wrench (as shown in FIG. 1) is thus worked out which comprises a handle 1 and a pair of rotatable boxes 3 of irregular hexgon pivoted at two ends of the handle 1. The handle 1 has a jaw 2 at each ends. When engages the box 3 with a working object such as a hexgon nut and rotates the handle 1, the jaw 2 presses a side of the object to reduce the size of the box 3 in order to fit the shape of the object and further to faster or unfasten the object. This type of combination wrench provides a limited range to fit some of the hexgon nuts. However, it has the advantages set forth as follows:

a) because of a greater wondering clearance, it causes a free run which damages or deforms the working object, b) the repeated engagement and/or disengagement with the object requires a rotation angle that greater the 60° which causes an operation limitation to the user, and c) it does not fit a small working object or operate within a small space.

SUMMARY OF THE PRESENT INVENTION

The present invention has a main object to provide a combination wrench with adjustable heads which heads can automatically stretched open to fit a working object.

Another object of the present invention is to provide a combination wrench with adjustable heads which can firmly engage the working object during rotation and the handle can be back run.

Accordingly, the combination wrench of the present invention comprises generally a handle, an open end pivoted to one end and box head pivoted to the other end of the handle. The heads each has a first and a second jaw pivoted together in a shear arrangement and biased at their inner ends with a spring means to force the jaws to stretch open. The jaws each has serration on inner surface and a stop block against a side of the handle. So that the jaws are usually stretched open to fit the size of a working object and firmly engage with the object when the handle rotates. Further the handle enables to back run during fastening or unfastening the working object.

The present invention will become more fully understood by reference to the following detailed description thereof when read in conjunction with the attached drawings.

DETAILED DESCRIPTION OF THE PREFERRED EMBODIMENT

Figure 1:
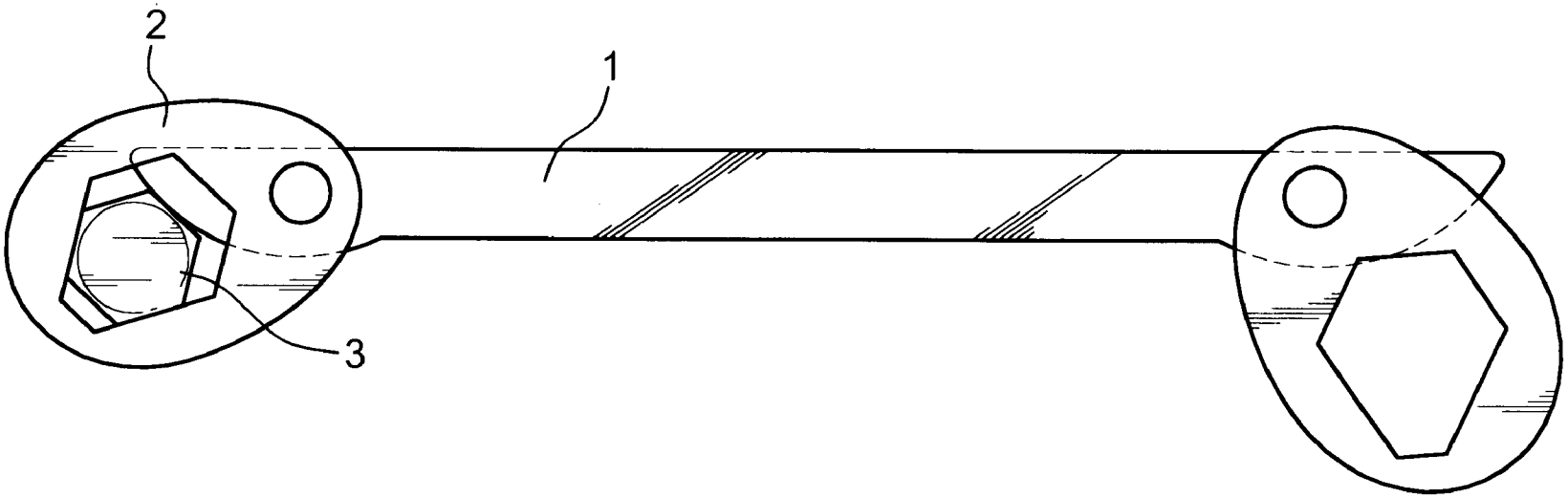
FIG. 1 Prior Art
FIG. 1 is plane view of a combination wrench according to a prior art.
Figure 2:
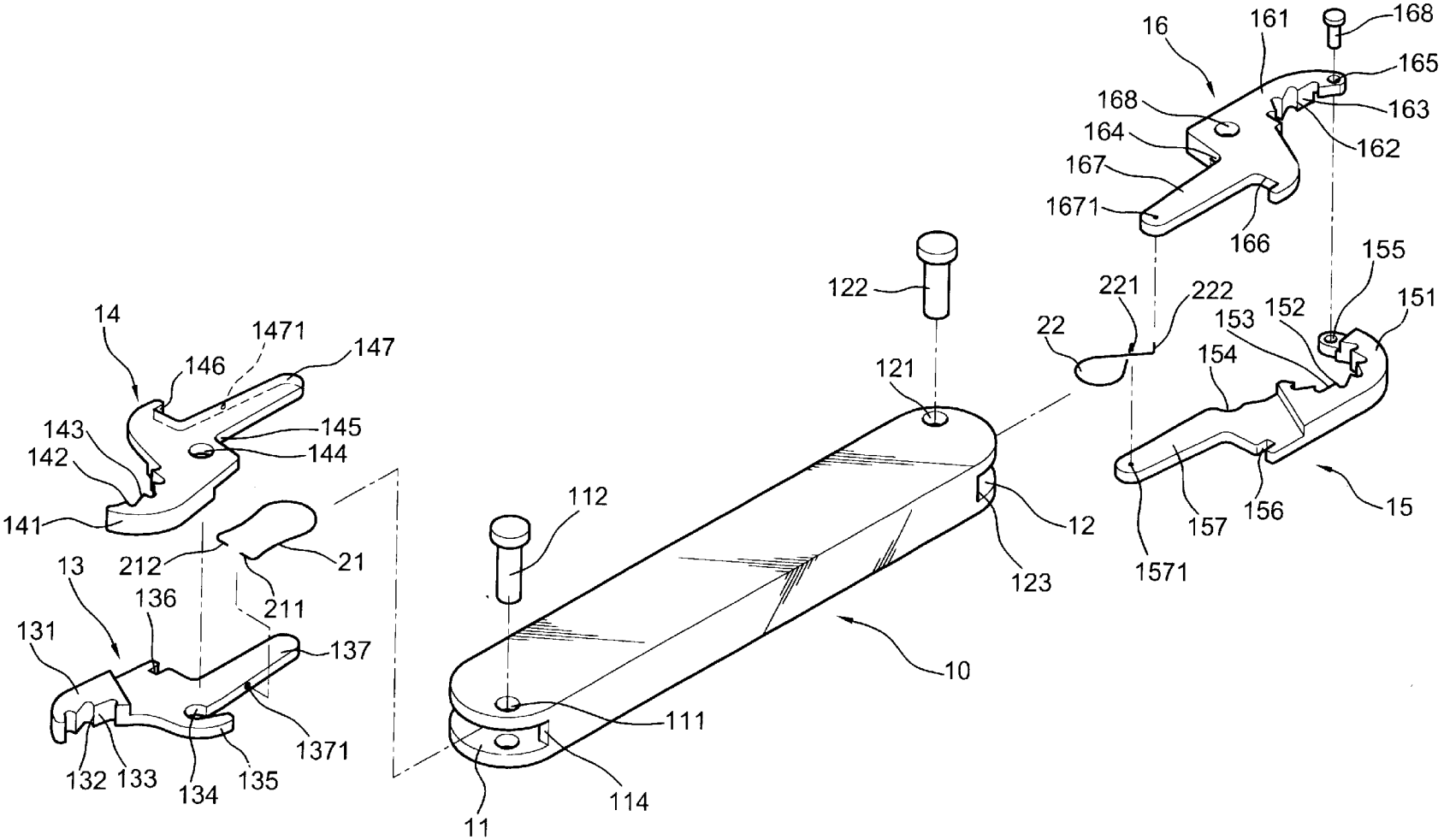
FIG. 2 is an exploded perspective view to show a combination wrench of a preferred embodiment according to the present invention.
Figure 3:
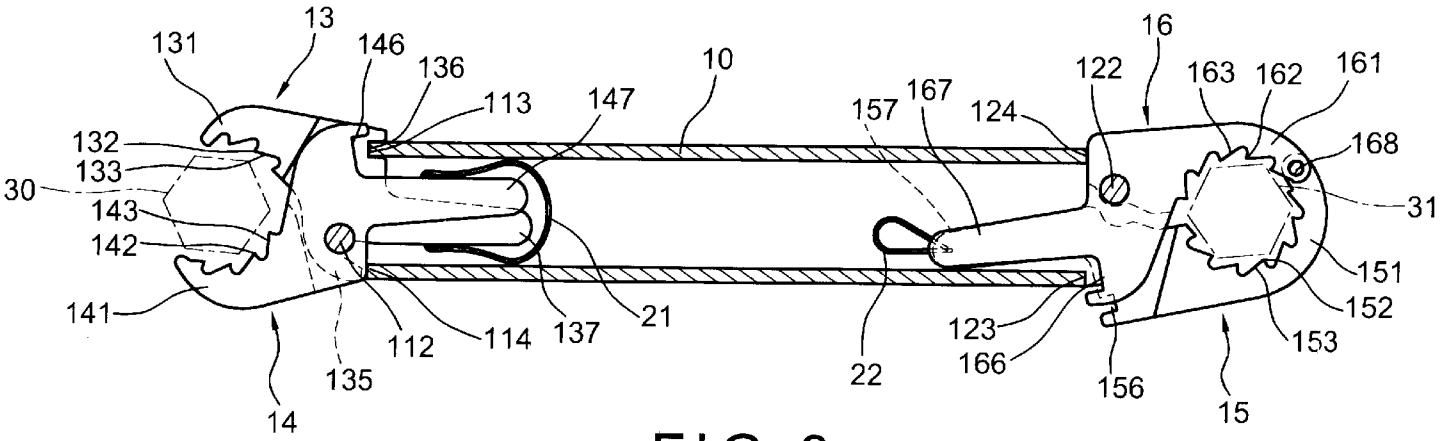
FIG. 3 is a sectional view of an assembled combination wrench of FIG. 2 while the heads are stretched open.

With reference to FIGS. 2 and 3 of the drawings, the combination wrench of the present invention comprises generally a rectangular handle 10, an adjustable open head pivoted to one end an adjustable box head pivoted to the other end of the handle 10 and a roughly U-shaped spring means.

The handle 10 has two round ends each including an opening 11 and 12 to define a lug, an aligned thru hole 111 and 121 in the lug for engaging with a rivet pin 112 and 122 and a pair of retaining edges 113 and 114, 123 and 124.

The open head is combined with a first and second jaw members 13 and 14. The first jaw member 13 has a first clamping jaw 131 including serrations 132 on inner side to define a plurality of bevel surfaces 133 therebetween, a first thru hole 134 abutting an extension 135 on an inner side of the jaw member, a first notch 136 in the other side opposite to the thru hole 134 and a first leg member 137 extending longitudinally from the thru hole 134 including a first lateral recess 1371 in a middle portion of the leg 137. The first thru hole 134 is engageable with the aligned thru hole 111.

The second jaw member 14 has a second clamping jaw 141 including serrations 142 on inner side to define a plurality of bevel surfaces 143 therebetween, a second thru hole 144 in a middle portion of the jaw member 14, a second notch 146 in an inner side of the jaw 14, a second leg 147 extending longitudinally from the thru hole 144 including a second lateral recess 1471 in a middle portion and a right angled portion 145 defined between the leg 147 and the jaw member 14.

The roughly U-shaped spring means 21 includes a pair of transverse ends 211 and 212 respectively engageable into the first and second lateral recesses 1371 and 1471 of the legs 137 and 147.

When assembling, put the second jaw member 14 on the first jaw member 13 and make alignment of the thru holes 134 with the thru hole 144 and engage the transverse portions 211 and 212 of the spring means 21 into the lateral recesses 1371 and 1471 respectively, then engage the legs 137 and 147 into the opening 11 of the handle and pivot the first and second clamping jaws 13 and 14 to the handle as the thru holes 134, 144 and 111 are aligned with each other (as shown in FIG. 3).

The box head is combined with a first and a second web member 15 and 16 and a roughly OC-shaped spring means 22.

The first web member 15 has a roughly U-shaped clamping jaw 151 including serrations 152 on inner side to define a plurality of bevel surfaces 153 therebetween, a semi-circular slot 154 in an inner side, a third thru hole 155 in a reduced distal of the clamping jaw 151, a third notch 156 positioned remote to the semi-circular slot 154 and a third leg 157 extending longitudinally from the slot 154 including a first vertical recess 1571 in a distal portion of the leg 157.

The second web member 16 has an arcuate clamping jaw 161 including serrations 162 on inner side to define a plurality of bevel suitcase 163 therebetween, a fourth thru hole 165 in a reduced distal of the clamping jaw 161 engageable with the third thru hole 155 of the first web member 15 and pivoted by a small rivet 168, a concave 166 in an inner side, a fourth leg 167 extending longitudinally from the concave 166 including a second vertical recess 1671 in a distal portion, a third thru hole 168 engageable with the semi-circular slot 154 and the first thru hole 121 and a right angled portion 164 defined between the fourth leg 167 and the second web member 16.

The roughly OC-shaped spring means 22 has a pair of vertical ends 221 and 222 respectively engageeable with the first and second vertical recesses 1571 and 1671 of the first and second web members 15 and 16. The vertical ends 1571 and 1671 are directionally toward each other.

When assembling, rotate the second web member 16 to overlap with first web member 15 until their legs 157 and 167 engaged with each other, then respectively engage the vertical ends 221 and 222 of the spring means 22 into the first and second vertical recesses 1571 and 1671 from the opposite side of the legs 157 and 167, and then insert the combined web members 15 and 16 into the opening 12 of the handle 10 and align the third thru hole 168 with the first thru hole 121 and finally, pivot the box head to the handle 10 by rivet 122 (as shown in FIG. 3).

Figure 5:
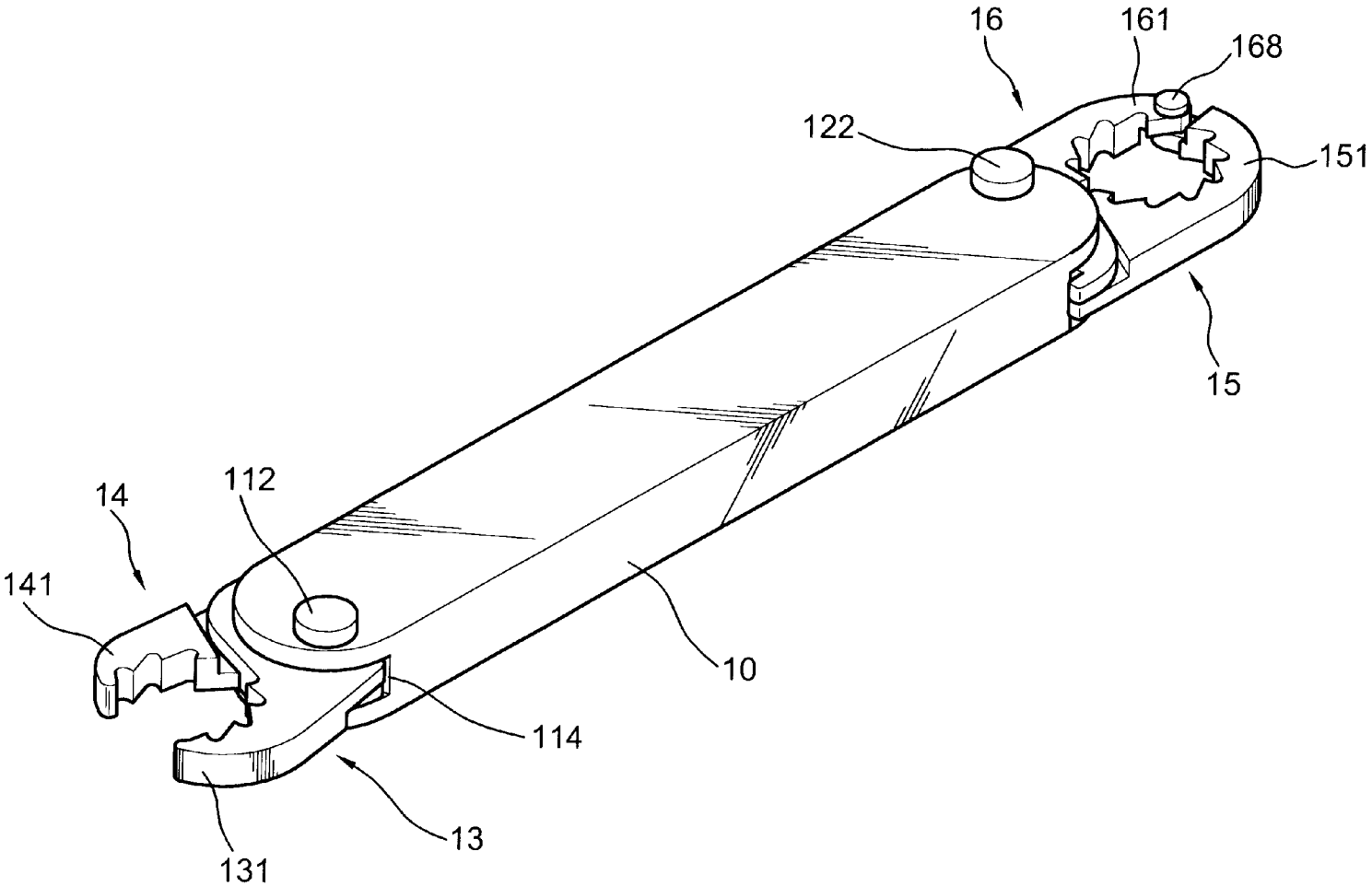
FIG. 5 is a perspective view to show an assembled combination wrench of the preferred embodiment.

FIG. 5 shows an outlook of the assembled combination wrench of the present invention.

Figure 4:
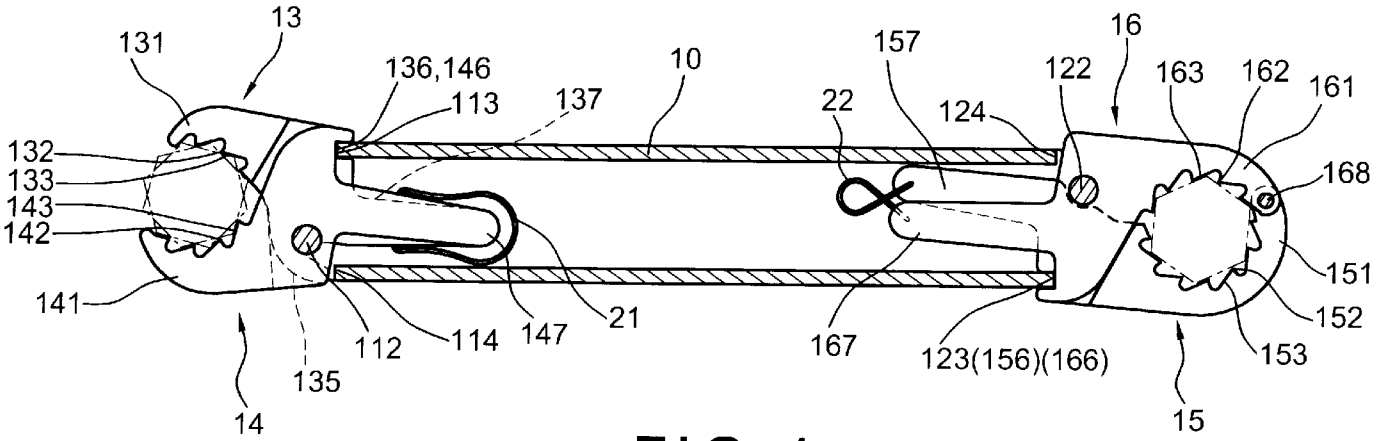
FIG. 4 is a sectional view of an assembled combination wrench of FIG. 2 while the heads are closed.

Referring to FIG. 4 and FIG. 3 again, both the open head and the box head are usually remaining in a stretch open position, however, the first notch 136 of the first clamping jaw 13 and the right angled portion 145 of the second clamping jaw 14 are retained respectively by the retaining edges 113 and 114, and the right angled portion of the second web member is retained by the retaining edge 124.

In operation, if use the open head, engage the clamping jaws 14 onto a working object such as a hexgon bolt 30 and rotate the handle 10 counterclockwise, the retaining edge 113 moves forward first stopping against the second notch 146 and then narrowing the space between clamping jaws 13 and 14 so as to firmly clamp to bolt 30 wherein the edges of the bolt 30 engage with the bevel surfaces 133 and 143 (as shown in FIG. 4). Further rotation of the handle 10 counterclockwise is to fasten or unfasten the bolt 30, slight rotation of the handle 10 clockwise can make back run of the open head because of the tension of the spring means 21 and the bevel surfaces of the clamping jaws 13 and 14.

If use the box head, engage the box head onto a hexgon bolt 31, then rotate the handle 10 counterclockwise also that the retaining edge 123 engage into both the concave 166 of the second web member 16 and the third notch 156 of the first web member 15 so as to firmly clamp the bolt 31. Further rotation of the handle 10 counterclockwise, one can fasten or unfasten the bolt 31. The box head can also make back run as decried the above for the open head.

Figure 6:
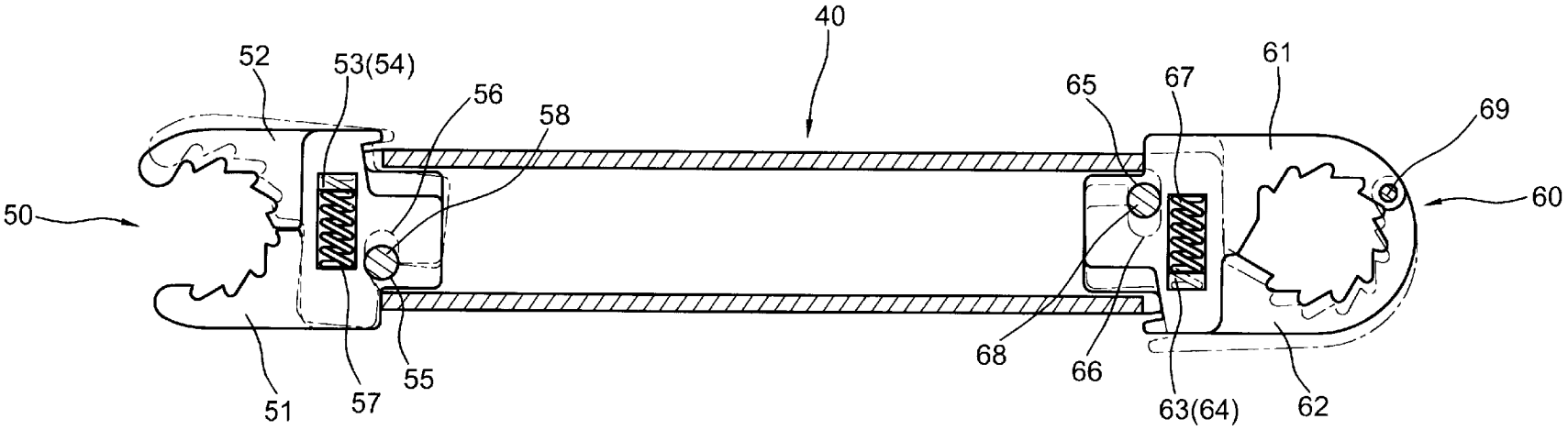
FIG. 6 is a sectional view to show an alternative embodiment of the present invention.

Referring FIG. 6, and alternative embodiment of the combination wrench of the present invention is provided. This embodiment comprises a hollow interior handle 40 having opening in each of the first and second ends and a thru hole abutting each of the first and second ends, an open head and a box head.

The open head includes a fixed jaw 51 and movable jaw 52 of serrated inner side. The fixed jaw 51 has a circular thru hole 55 engageable with the thru hole at the first end of the handle 40 and secured by rivet 58 and a rectangular hole 53 into which a spring 57 is rotatably secured. The movable jaw has an oblong hole 56 slidably engaged with the rivet 58 and a threaded rectangular hole 54 engaged with the spring 57. So that the movable jaw 52 can slide in or out relative to the fixed jaw 51 to readily clamp a working object which is to be fastened or unfastened.

The box head has a fixed web 51 and a movable web 52 pivoted at their forward ends by a small rivet and both of them having inner serrations. The fixed web has a circular thru hole 65 engageable with thru hole at the second end of the handle 40 and secured by rivet 68 and a rectangular hole 53 into which a spring 67 is rotatably secured. The movable web 62 has an oblong hole 66 slidably engaged with the rivet 68 and a threaded rectangular hole 64 engaged with the spring 67. So that the movable jaw 62 can slide in or out relative to the fixed jaw 61 to clamp a working object which is to be fastened or unfastened.

The specification relating to the above embodiments should be construed as exemplary rather than as limitative of the present invention, with many variations and modifications being readily attainable to a person of average skill in the art without departing from the spirit or scope thereof as defined by the appended claims and their legal equivalents.

I claim:

1. A combination wrench comprising:

a rectangular handle having a first and a second end of round outer periphery, each of the ends including an opening to define a lug, a aligned thru hole and a pair of first and second retaining edges on lateral side of the opening respectively;

an open head pivoted to the aligned thru hole of the first end of the handle, said open head having a first clamping jaw including a first jaw member of serrated inner side, a first thru hole butting an extension on one side of the clamping jaw remote from the first jaw member and engageable with the aligned thru hole of the first end of the handle, a first notch in other side opposite to the first thru hole and a first leg member extending longitudinally from the first thru hole having a first lateral recess in a middle portion thereof; a second clamping jaw including a second jaw member of serrated inner side, a second thru hole engageable with the first thru hole of the first clamping jaw and the aligned thru hole of the first end of the handle and pivotally secured by a first rivet, a second notch in aside opposite to the second thru hole and a second leg member extending longitudinally from the second thru hole having a second lateral recess in a middle portion thereof; and a U-shaped spring means biased to the first and second leg members, said spring means having a pair of transverse ends inserted into the first and second recesses of the leg members respectively;

a box head pivoted to the aligned thru hole of the second end of the handle, said box head having a first web member including a first web and a second web pivoted together at their reduced ends by a small rivet and each including a serrated inner side, said first web having a semi-circular hole in an inner side engageable with the aligned thru hole of the second end of the handle, a third notch in other side opposite to the semi-circular hole and a third leg member extending longitudinally first the semi-circular hole including a first vertical recess in a distal portion thereof, said second web having a fourth notch in an inner side, a third thru hole in a side opposite to the fourth notch and engaged with the aligned thru hole of the second end of the handle and pivotally secured by a second rivet, a fourth leg member extending longitudinally from the fourth notch including a second vertical recess in a distal portion thereof and a right angled portion defined between the fourth leg member and an inner side of the second web; an OC-shaped spring means engaged with the third and fourth leg member from opposite sides thereof, said spring means having a pair of vertical ends directionally toward each other and inserted into the first and second vertical recesses respectively.

2. The combination wrench as recited in claim 1 wherein the extension of said first clamping jaw and the right angled portion of said second clamping jaw are engageable with the first retaining edge of the first end of said handle.

3. The combination wrench as recited in claim 1 wherein the first notch of said first clamping jaw and the second notch of said second clamping jaw are engageable with the second retaining edge of the first end of said handle.

4. The combination wrench as recited in claim 1 wherein the third notch of said first web and the fourth notch of said second web are engageable with the first retaining edge of the second end of said handle.

5. The combination wrench as recited in claim 1 wherein the right angled portion of said second web is engageable with the second retaining edge of the second end of said handle.

* * * * *